US010167565B2

(12) United States Patent
Savidand et al.

(10) Patent No.: US 10,167,565 B2
(45) Date of Patent: Jan. 1, 2019

(54) METHOD AND DEVICE FOR ELECTROPLATING IN CYLINDRICAL GEOMETRY

(71) Applicants: ELECTRICITE DE FRANCE, Paris (FR); CENTRE NATIONAL DE LA RECHERCHE SCIENTIFIQUE-CNRS-, Paris (FR)

(72) Inventors: Gregory Savidand, Orsay (FR); Nicolas Loones, Nanterre (FR); Daniel Lincot, Antony (FR); Elisabeth Chassaing, Paray-vieille-poste (FR)

(73) Assignees: ELECTRICITE DE FRANCE, Paris (FR); CENTRE NATIONAL DE LA RECHERCHE SCIENTIFIQUE-CNRS-, Paris (FR)

( * ) Notice: Subject to any disclaimer, the term of this patent is extended or adjusted under 35 U.S.C. 154(b) by 242 days.

(21) Appl. No.: 14/783,553

(22) PCT Filed: Mar. 25, 2014

(86) PCT No.: PCT/FR2014/050703
§ 371 (c)(1),
(2) Date: Oct. 9, 2015

(87) PCT Pub. No.: WO2014/167201
PCT Pub. Date: Oct. 16, 2014

(65) Prior Publication Data

US 2016/0083861 A1 Mar. 24, 2016

(30) Foreign Application Priority Data

Apr. 10, 2013 (FR) ..... 13 53249

(51) Int. Cl.
*C25D 5/00* (2006.01)
*C25D 5/48* (2006.01)
(Continued)

(52) U.S. Cl.
CPC ..... *C25D 7/12* (2013.01); *C25D 5/028* (2013.01); *C25D 5/04* (2013.01); *C25D 5/10* (2013.01);
(Continued)

(58) Field of Classification Search
CPC ..... C25D 5/04; C25D 5/50
(Continued)

(56) References Cited

U.S. PATENT DOCUMENTS 902,892 A 11/1908 Lutz
4,102,770 A * 7/1978 Moriarty ..... C25D 21/10 204/212
(Continued)

FOREIGN PATENT DOCUMENTS

DE 197 51 021 A1 5/1999
EP 0 143 868 A2 6/1985
(Continued)

OTHER PUBLICATIONS

Low et al., "Numerical Simulation of the Current, Potential and Concentration Distributions Along the Cathode of a Rotating Cylinder Hull Cell," Electrochimica Acta (2007), vol. 52, pp. 3831-3840. (Year: 2007).*
(Continued)

*Primary Examiner* — Edna Wong
(74) *Attorney, Agent, or Firm* — Drinker Biddle & Reath LLP

(57) ABSTRACT

A method and device for electrodeposition in cylindrical geometry. A method for electrochemically depositing a thin layer on a flexible substrate, comprising: providing, in an electrolysis bath, a first closed cylinder in a second hollow cylinder, applying the flexible substrate to one of the surfaces chosen from the outer surface of the first cylinder and the inner surface of the second, the flexible substrate form-
(Continued)

ing a first electrode, providing, in the electrolysis bath, a second electrode, and applying a potential difference between the first electrode and the second electrode in order to electrodeposit the thin layer on the flexible substrate.

9 Claims, 5 Drawing Sheets

(51) Int. Cl.

| | |
|---|---|
| ***C25D 7/12*** | (2006.01) |
| ***C25D 5/02*** | (2006.01) |
| ***C25D 7/06*** | (2006.01) |
| ***C25D 17/00*** | (2006.01) |
| ***C25D 17/02*** | (2006.01) |
| ***C25D 17/06*** | (2006.01) |
| ***C25D 17/10*** | (2006.01) |
| ***C25D 17/12*** | (2006.01) |
| ***C25D 21/10*** | (2006.01) |
| ***C25D 5/04*** | (2006.01) |
| ***C25D 5/10*** | (2006.01) |
| ***C25D 5/50*** | (2006.01) |
| ***C25D 9/08*** | (2006.01) |

(52) U.S. Cl.
CPC ..... *C25D 5/50* (2013.01); *C25D 7/0635* (2013.01); *C25D 9/08* (2013.01); *C25D 17/004* (2013.01); *C25D 17/005* (2013.01); *C25D 17/02* (2013.01); *C25D 17/06* (2013.01); *C25D 17/10* (2013.01); *C25D 17/12* (2013.01); *C25D 21/10* (2013.01); *C25D 5/003* (2013.01)

(58) Field of Classification Search
USPC ..... 205/143, 224
See application file for complete search history.

(56) References Cited

U.S. PATENT DOCUMENTS

| | | | | | |
|---|---|---|---|---|---|
| 6,139,711 | A * | 10/2000 | Abys | C25D 21/12 | 204/212 |
| 6,153,065 | A * | 11/2000 | Yamamoto | C25D 17/00 | 204/212 |
| 6,162,333 | A * | 12/2000 | Lemon | C25C 7/02 | 204/260 |
| 6,406,610 | B1 | 6/2002 | Lowe | | |
| 2005/0282371 | A1* | 12/2005 | Patton | C25D 3/38 | 438/597 |
| 2014/0080249 | A1 | 3/2014 | Savidand et al. | | |

FOREIGN PATENT DOCUMENTS

| | | | | | |
|---|---|---|---|---|---|
| EP | 0143868 | A2 * | 6/1985 | B05C 3/10 | |
| FR | 2 975 107 | A1 | 11/2012 | | |
| FR | 2 975 223 | A1 | 11/2012 | | |
| JP | 58081990 | A * | 5/1983 | B05C 13/02 | |
| JP | 62-21296 | A | 1/1987 | | |
| JP | 62021296 | A * | 1/1987 | C25D 5/08 | |
| JP | 2009-120935 | A | 6/2009 | | |

OTHER PUBLICATIONS

Examination Report issued in related patent application EP 14719044.1, dated Mar. 23, 2017, 6 pages.

* cited by examiner

METHOD AND DEVICE FOR ELECTROPLATING IN CYLINDRICAL GEOMETRY

CROSS-REFERENCE TO RELATED APPLICATIONS

This application is the U.S. national phase of the International Patent Application No. PCT/FR2014/050703 filed Mar. 25, 2014, which claims the benefit of French Application No. 13 53249 filed Apr. 10, 2013, the entire content of which is incorporated herein by reference.

TECHNICAL FIELD

The invention relates to the field of technologies for electroplating conducting and semiconducting compounds on flexible metal substrates.

TECHNOLOGICAL BACKGROUND

The production of photovoltaic panels, in particular panels called "flat plate" involving thin layers, calls for plating methods of compounds from columns 11, 12, 13, 14 and 16 of the periodic table, such as for example those based on Cu, Zn, Sn, In, Ga, Al, Se and S and also compounds based on selenides, tellurides or sulfides. These platings are conventionally done by two types of technologies: processes referred to as "batch" associated with rigid substrates, or those referred to as "roll-to-roll", incorporating flexible substrates unrolled over an entire production line.

From an industrial perspective, the roll-to-roll process has the advantage of reducing the mass of panels and increasing the production tempo compared to the batch processes, thereby reducing the production costs. Nevertheless, the transition from batch methods to roll-to-roll methods requires performance validation steps.

At the present time, roll-to-roll technologies are not as well-managed as batch technologies, which deprives devices involving flexible substrates from precise, economical and reliable production methods.

Document U.S. Pat. No. 6,406,610 proposes an electrolytic bath in which is immersed a flexible substrate moving past a nearby anode. Document DE 19751021 also proposes an electrolytic device using a roll-to-roll method, operating by scrolling a flexible substrate in a bath containing an anode.

The techniques proposed in these documents however use tanks whose geometry does not optimize the homogenization of the solution present in the electrolytic bath. Additionally, these tanks could benefit from an optimization aiming to reduce the quantity of solution necessary for electroplating.

More advantageous geometries are known in the batch methods. In particular, with a cylindrical geometry, like the one described in document U.S. Pat. No. 5,628,884, hydrodynamic control can be used to advantage by rotating a rigid cylindrical substrate around its axis in an electrochemical bath contained in a tank which itself is cylindrical.

There is therefore a need to optimize the electroplating technologies used for handling the flexible substrates, so as to be able to benefit from both some advantages provided by known technologies and used in the batch methods while also benefiting from production cost savings and speed of roll-to-roll technologies.

SUMMARY OF THE INVENTION

To get there, the present invention proposes a method for plating a thin layer on a flexible substrate, by electrochemistry, comprising the following steps:

- providing, in an electrolytic bath, a first closed cylinder inside a second hollow cylinder,
- applying the flexible substrate to one of the surfaces among the outer surface of the first cylinder and the inner surface of the second cylinder where the flexible substrate forms a first electrode,
- providing, in the electrolytic bath, at least one second electrode, and
- applying a potential difference between the first electrode and the second electrode to electroplate the thin layer on the flexible substrate.

There are in particular two possible configurations for positioning the substrate. The substrate can be placed on the outer surface of the closed cylinder or else on the inner surface of the hollow cylinder. Advantageously the substrate forms a cathode. The second electrode is advantageously an anode and can be on a third cylinder placed in the electrolytic bath, or again on the other cylindrical surfaces present in the electrolytic bath or even be a substantially flat electrode immersed in the electrolytic bath.

This method has the advantage of allowing a savings in the volume of electrolytic solution used. Indeed, in a cylindrical geometry, the electrolytic solution is contained between the outer surface of the closed cylinder and the inner surface of the hollow cylinder forming a tank. The cylindrical geometry electrolysis reactor does not need the use of a stirring system to homogenize the solution. The distance separating the cathode from the tank is therefore small and makes savings of electrolytic solution possible.

Additionally, this geometry is particularly suited to flexible substrates because these substrates fit on a large curved surface on less bulky cylinders than the electrolysis tanks with parallelepiped geometry.

With the cylindrical geometry for electroplating of flexible substrates, the parameters for plating chemical elements on the substrate can be controlled more precisely. In particular, the electroplating speed or the composition of the plating can be controlled at least by using several distinct parameters such as the concentration of electroactive species in the solution, the electric current circulating between the two electrodes, the applied potential and the rotation speed.

The application of a potential difference between the first electrode and the second electrode can be done by applying a current between the two electrodes or else by applying a voltage between these electrodes.

The first electrode is a cathode whereas the second electrode is an anode. A supplementary reference electrode could be provided.

Additional steps can be implemented to improve the electroplating method.

Thus, it is possible to rotate the first cylinder around its axis during electroplating.

With this rotation, stirring systems for homogenizing the electrolytic solution can be omitted. Furthermore, through control of the rotation speed, various operating regimes can be chosen: plating in laminar flow, or turbulent flow with or without vortices. These possibilities contribute to an improved control of the electroplating quality. In particular it is advantageous to choose a laminar flow regime in order to benefit from a homogeneous solution and allowing a chemical-element plating resulting in a layer having few surface irregularities.

Advantageously, the second electrode is rotating. Rotating the second electrode can serve to homogenize the solution or even place it in the specific hydrodynamic regime, by mixing within the electrolytic solution. Another advantage, in the scenario in which the second electrode is not on the surface of one of the two cylinders, is to not continually keep the same zone of the substrate facing the second electrode. The second electrode therefore advantageously turns around the closed cylinder but can also turn around itself, in particular when the geometry of the second electrode allows it to mix the electrolytic solution because of this rotation, for example when the second electrode is on one of the two cylinders. In a particular embodiment, in which the second electrode and the cathode are on cylinders with substantially parallel, different axes, the second electrode and the cathode can turn around each other in addition to turning around their respective axes in the electrolytic bath.

Advantageously, the method can provide a first, closed cylinder co-axial with the second, hollow cylinder. This arrangement of the first closed cylinder in the tank formed by the second hollow cylinder serves to support a laminar hydrodynamic regime when one or both of the cylinders turn around their mutual respective axes.

In some embodiments, it is not necessary to add a second electrode into the tank. Indeed, the other surface among the outer surface of the first cylinder and the inner surface of the second cylinder can be intended to be the second electrode.

This configuration is particularly advantageous in that it makes it possible to benefit from a constant distance between the second electrode and the cathode in the electrolytic bath at least for the conducting portions facing each other. In this way the circulation of cations between the second electrode and the cathode occurs more homogeneously in the electrolytic bath. In this embodiment, the second electrode is advantageously a counter-electrode forming an anode.

Some plating can be done by progressive dissolving of a second soluble electrode in the electrolytic bath. For example, it could involve a second electrode of copper in a copper sulfate solution. When a current is applied between the second electrode and the cathode, the plating of a cation on the substrate causes the release of a copper atom, which transforms into a cation, from the soluble second electrode. In this way, the electroplating can continue until the complete consumption of the second electrode.

The second electrode can therefore be chosen preferably of the same nature as the ions in solution, because it serves to continuously regenerate the solution which provides even better flexibility in connection with an industrial application.

So as to be able to move from a distance the closed cylinder carrying the substrate, the method can provide for a mobile carrier arm connected to the first cylinder, when the flexible substrate is applied on the outer surface of the closed first cylinder. This carrier arm could be intended to undergo a rotation around an axis outside the electrolytic bath and a translation parallel to the axis of the first cylinder. It can also be intended to undergo radial displacement.

Using the carrier arm mentioned above, a displacement of the first cylinder from the electrolytic bath in the second cylinder to at least one tank in a third cylinder is possible. In this way, the method can involve several distinct successive plating steps, which is particularly suited to industrial methods.

Because of the movement of the carrier arm from one tank to the other, the method can be enriched with steps other than electroplating steps. In particular, the method can comprise the movement of the first cylinder towards an annealing enclosure. Annealing steps are particularly useful for producing photosensitive devices such as photovoltaic cells.

In parallel to the electroplating method described above, the invention also relates to the cylindrical reactor geometry used during the method.

Thus, the invention also relates to a device for electrochemically plating at least one thin layer on a substrate, comprising:

- a first closed cylinder arranged inside a second, hollow cylinder,
- a flexible substrate forming a first electrode on one of the surfaces among the outer surface of the first cylinder and the inner surface of the second cylinder,
- a second electrode.

This device proposes using a cylindrical geometry reactor in combination with a flexible substrate. With this combination it is possible to benefit from a smaller volume of electrolytic solution than in a parallelepiped geometry to do the plating, and also to do the plating in a more homogeneous solution because of the more attractive possibilities for mixing a solution contained between a closed cylinder and a hollow cylinder.

With this device two positions for the substrate can also be chosen. The substrate can indeed be placed on the outer surface of the closed cylinder or else on the inner surface of the hollow cylinder forming the electrolytic bath.

Several configurations are conceivable for this device.

More specifically, it is possible to have the other surface among the outer surface of the first cylinder and the inner surface of the second cylinder for the second electrode.

With this configuration it is also possible to benefit from a first electrode arranged opposite the second electrode with a constant distance between these two electrodes. This configuration is particularly advantageous in the situation where the two electrodes cover the entire surface of the first and second cylinders on which they are respectively placed.

Movement of the cylinder carrying the substrate can be done remotely in a controlled manner, in particular using a carrier arm connected to the first cylinder. Means for connecting the first cylinder to the carrier arm can therefore be provided on the first cylinder. When the substrate is not carried on the first closed cylinder, the carrier arm can be used to mix the electrolytic solution by performing a controlled rotation of the cylinder around its axis and possibly by translating the cylinder in the electrolytic bath.

The electroplating using the device mentioned above can advantageously make use of several steps. Consequently, the invention also relates to a facility comprising a device such as described above.

According to an embodiment, such an installation furthermore includes:

- a mobile carrier arm, connected to the closed first cylinder, and
- at least one annealing enclosure.

These items are specifically suited for electroplating for implementing photosensitive cells. Indeed, by using the carrier arm, the substrate advantageously mounted on a closed cylinder can be moved from one tank to another. Furthermore, it is advantageous to provide a collar forming a cover rigidly connected to the carrier arm in order to seal the successive tanks of the facility.

Reducing annealing and high temperature, for example over 400° C., vapor phase deposition steps can be done using the annealing enclosure.

Advantageously, the carrier arm can comprise a collar intended to close the second cylinder. This collar can form an upper cover closing the various tanks in the facility, such as, for example, the electrolysis tanks and the annealing enclosure. In this way, it is possible to:

- inject a neutral gas in the tanks, to avoid any oxidation phenomena,
- avoid splashes of electrolytic solution out of the tanks or
- isolate the annealing enclosure from the remainder of the facility in order to avoid exposing the tanks to the high temperatures to which the substrate is exposed in the enclosure.

BRIEF DESCRIPTION OF THE DRAWINGS

The method which is the subject of the invention will be better understood by reading the description and observing the drawings below in which.

DETAILED DESCRIPTION

Figure 1:
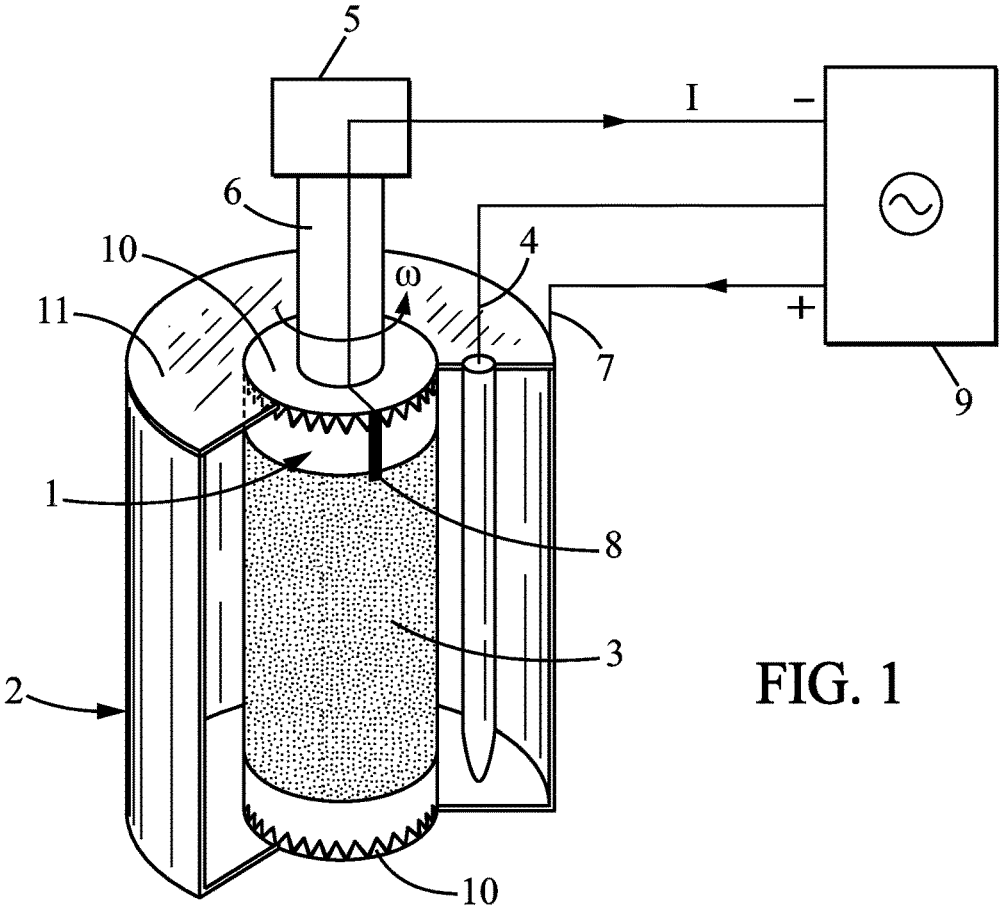
FIG. 1 illustrates a sample electroplating device with cylindrical geometry that can come from the method that is the subject of the invention.

As shown in FIG. 1, the invention makes use of a cylindrical geometry electroplating device including a substantially cylindrical tank 2 in which a closed cylinder 1 is inserted. As shown in FIG. 1, the closed cylinder 1 includes a flexible substrate 3 on a portion of the outer surface thereof. This substrate is connected to a supply 9 in order to form a first electrode 8, which advantageously forms a cathode. As shown in FIG. 1, the tank 2 is also connected to the supply 9 in order to form a second electrode 7, which is advantageously a counter-electrode or anode 7. A reference electrode 4, which serves as an independent potential probe, can also be provided in the electrolytic bath between the closed cylinder 1 and the tank 2.

In a first step, the electrolytic bath delimited by tank 2 is filled with an electrolytic solution whose concentration C is chosen on the basis of specific plating parameters. The electroplating starts by applying an electric current I or a voltage between the substrate and the reference electrode or even a voltage applied between the substrate and the anode generated by a supply 9 between the anode 7 and the cathode 8. The closed cylinder 1 is then rotated at an angular velocity ω, using the motor 5 actuating an arm 6. The angular velocity ω will subsequently be designated as being the rotation speed of the closed cylinder 1 around the axis thereof in tank 2.

Figure 2:
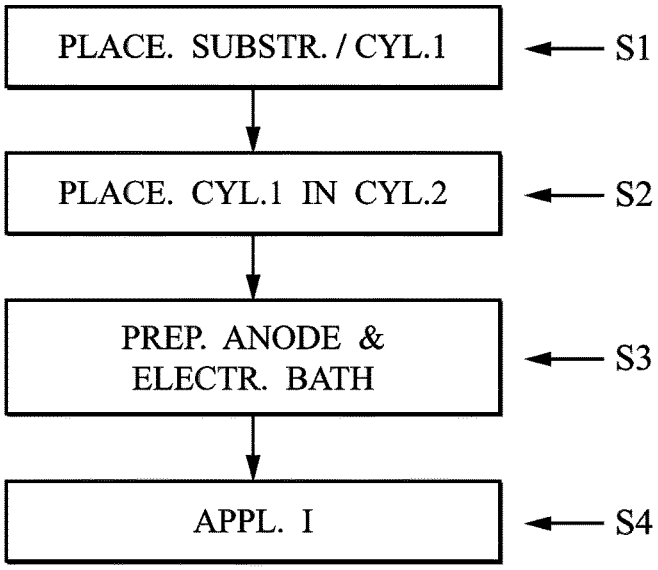
FIG. 2 shows the four principal steps of the electroplating method that is the subject of the invention.

The electroplating method of the invention includes four main steps shown in FIG. 2. A first step, S1, consists in placing the flexible substrate 3 on a cylinder. Two notable cases can arise.

In a first embodiment, it is advantageous to place the substrate 3 on the outer surface of the closed cylinder 1. This substrate can be kept in place by means of toothed discs 10, or any other attachment means for a flexible substrate on a cylindrical surface, such as for example application of an adhesive, holding by depressurization under the substrate 3 or even holding by a mechanical jaw of material that is inert in chemical solution. The curved surface of the closed cylinder 1 can furthermore be the substrate 3 itself, on the condition that the substrate provides a tight seal and does not allow the electrolytic solution to go inside the closed cylinder 1. When the substrate 3 is not an intrinsic part of the closed cylinder 1, the closed cylinder 1 can have an electrically insulating outer surface, in order to avoid electroplating on areas outside the substrate 3. In the opposite case, an electrically insulating material can be applied in the areas outside the substrate 3 exposing an electrically conducting surface of the closed cylinder 1.

An alternative embodiment consists in placing the flexible substrate 3 on the inner surface of the tank 2. In this embodiment, the closed cylinder 1 can be electrically conducting and form a second electrode, which can be a counter-electrode or anode 7. The closed cylinder 1 can also be at least partially covered with a conducting material to form a second electrode, counter-electrode or anode 7. The tank 2 can advantageously be electrically insulating, or, in the opposite case, the exposed electrically conducting areas can be covered with an electrically insulating material.

A third alternative can consist in placing the substrate 3 on the outer surface of the closed cylinder 1 and placing a second, substantially cylindrical, electrode 7 in the substantially cylindrical tank 2. This second electrode 7 can be a closed cylinder at least partially covered with a conducting element connected to the supply 9. These two cylinders can be rotated around their respective axes and move in the tank 2 so as to mix the electrolytic solution during the electroplating method.

After this first step S1 of installation of the flexible substrate 3 on a cylinder, it is appropriate in step S2 to put the closed cylinder 1 into position in the hollow cylinder 2. This placement can advantageously be done such that the closed cylinder 1 and the tank 2 are substantially co-axial. By placing the closed cylinder 1 in the tank 2 such that the two cylinders are co-axial, it is possible to benefit from specific hydrodynamics for homogenizing the electrolytic solution.

The electrolytic bath is advantageously prepared in the following step S3. This preparation includes pouring a liquid electrolyte solution in the volume located between the closed cylinder 1 and the tank 2. It also involves applying electrical contacts connecting the substrate 3 to an electrical supply 9 and also the counter-electrode 7, which could be the tank 2, to this same electric supply 9. It is also advantageous to arrange in the space located between the anode 7 and the cathode 8 a reference electrode 4, which serves as an independent potential probe. The flexible substrate 3, covered with a metal layer, for example molybdenum, can be electrically connected with a copper ribbon. In order to avoid depositing elements on this ribbon, the exposed surface thereof can be covered with electrically insulating material.

It is also possible to invert the steps S2 and S3.

According to an advantageous embodiment, the tank 2 is not the second electrode 7, and this second electrode 7 is an electrode soluble in the electrolytic solution and made up of the material that is intended to be plated on the substrate 3.

The electroplating, strictly speaking, starts once an electric current I is applied by the supply 9 between the two electrodes 7 and 8, for example between the anode 7 and the cathode 8. This current is delivered in step S4. Because of this current, the cations, for example at least one element from columns 11, 12, 13, 14 or 16, present in the electrolytic solution, migrate from the second electrode, for example the anode 7, to the substrate 3, forming cathode 8. When the counter-electrode 7 is soluble, the application of a current progressively dissolves the anode 7 in the electrolytic bath. For example, the anode 7 can be copper immersed in an electrolytic solution of copper sulfate or nitrate. During the electroplating, the plating of copper on the substrate 3 by reduction of ions in the solution is accompanied by the dissolution of the same quantity of copper from the anode 7.

Advantageously, the method includes an additional step of rotating the closed cylinder 1 relative to the hollow cylinder 2. With this rotation it is possible to generate a specific hydrodynamics in the electrolytic solution so as to homogenize the solution and thereby guarantee a more uniform plating of the chemical elements on the substrate 3.

Furthermore, rotating tank 2 around its axis instead of rotating the closed cylinder 1 around its axis is conceivable. The resulting homogenization effect is equivalent.

The electroplating on flexible substrate 3 is thus controlled by three parameters: the cation concentration C in the electrolytic solution, the intensity I of the electric current delivered by the supply 9 or the plating potential V between the substrate and the reference electrode 4, and the angular velocity $\omega$ of the closed cylinder 1 around its axis in the tank 2.

Through a close determination of these three parameters, it is possible to guarantee an electrochemical plating controlled in composition and in thickness.

Figure 3A:
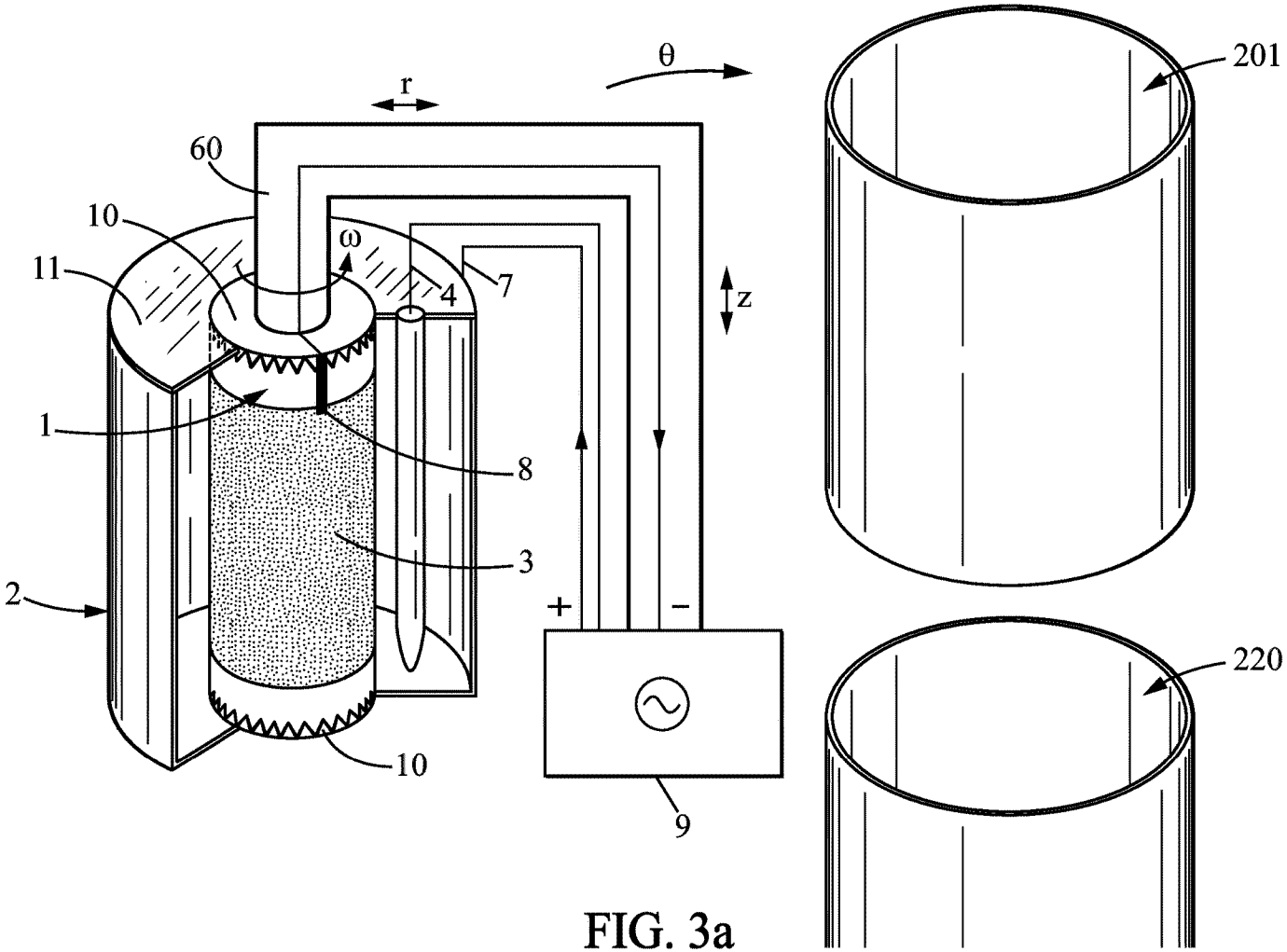
FIG. 3*a* is a schematic perspective representation of a cylindrical geometry electroplating facility according to an embodiment.
Figure 3B:
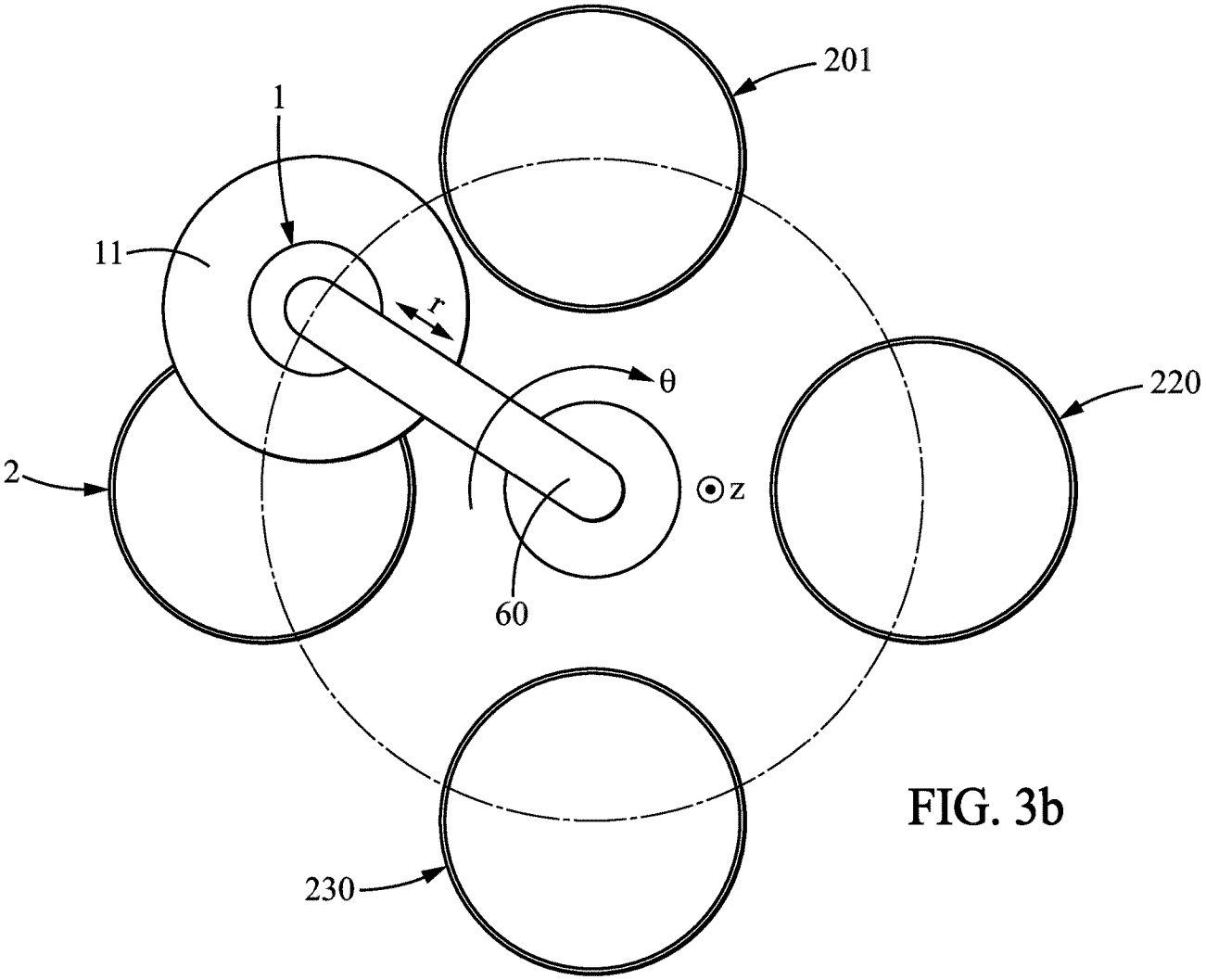
FIG. 3*b* is a schematic representation of a cylindrical geometry electroplating facility according to the embodiment of FIG. 3*a* seen from above.

Advantageously, the electrochemical plating is done in more than one step in order to build up a complex device, for example a photosensitive panel on flexible substrate 3. The devices involved in the production of such a panel according to the method that is the subject of the invention are shown in FIGS. 3*a* and 3*b*. The production of such a panel advantageously includes several successive liquid phase electroplatings. In a first part, copper, indium and gallium can be plated. The resulting layer can next advantageously undergo reducing annealing in gaseous phase in an annealing enclosure 201. To do that, the closed cylinder 1 comprising the flexible substrate 3 can be moved using a carrier arm 60, which is intended to undergo a translation along the axis of the cylinder and a rotation around an axis substantially parallel to that of the closed cylinder 1 and located outside of the tank 2. In this way, it is possible to install several electrolytic baths in cylindrical tanks 2, 220, 230 advantageously arranged in a circle around the carrier arm 60. The closed cylinder 1 carrying the flexible substrate 3 can then be moved from one bath to another by translation and rotation of the carrier arm 60. Furthermore, the carrier arm 60 can advantageously also move by radial translation, together with the two modes of movement mentioned above, thereby allowing movement in the three spatial directions.

The step of reducing annealing, for example under hydrogen atmosphere, can be done in an annealing enclosure 201 in which the flexible substrate 3 undergoes thermal treatment by hot gas propulsion, as described in patents FR 2,975,223 and FR 2,975,107. Advantageously, the carrier arm 60 then includes a collar forming a cover 11 installed above the closed cylinder 1 and suited to close the tanks for the electrolytic baths 2, 220, 230, as well as the reducing enclosure 201. Closing the reducing enclosure 201 is particularly advantageous considering that the presence of hydrogen could react on contact with oxygen present in the air. By closing the tanks 2, 220, 230, it is possible to make a primary vacuum or else inject a neutral gas into the tanks in order to avoid oxidation of the walls of the electrodes and cylinders not immersed in the electrolytic solution in addition to those which are immersed in the electrolytic solution.

The reducing annealing step can advantageously be followed by a selenization or sulfurization step done in the same enclosure 201 in vapor phase and at temperatures over 400° C.

Subsequently, the resulting device, including for example a Cu(In, Ga)$Se_2$ type absorber layer, undergoes two other platings in liquid phase. These platings can be: a first plate, by chemical route, of cadmium sulfide (CdS), forming a buffer layer, and a second zinc oxide (ZnO) electroplating, forming a transparent conducting layer corresponding to the upper electric contact of the photosensitive panel, where the initial metal layer of the flexible substrate 3, for example of molybdenum, forms the rear contact.

Beyond the electroplating method, the invention also relates to an electroplating device with cylindrical geometry for flexible substrate 3.

Figure 4:
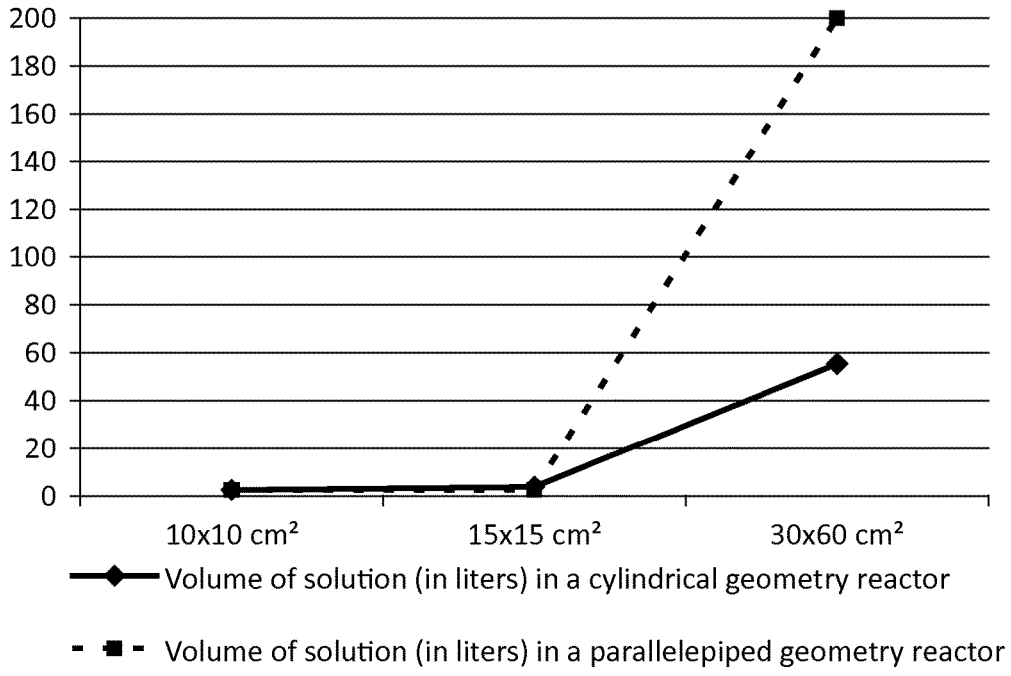
FIG. 4 is a graphic showing the volume of electrolytic solution in liters used in parallelepiped and cylindrical shaped electrolytic baths for three different substrate sizes.

With the cylindrical geometry electroplating device it is possible to realize substantial savings in volume of electrolytic solution compared to parallelepiped geometry electroplating devices. Indeed, the electrolytic solution is included in the volume delimited by the closed cylinder 1 on the one hand and the tank 2 on the other. It hence appears that the cylindrical geometry makes it possible to reduce the quantities of electrolytic liquid used by increasing the size of the closed cylinder 1. The larger the size of the substrate 3—and therefore the larger the outer surface of the closed cylinder 1—the larger is the savings in the volume of solution. FIG. 4 is a chart showing various electrolytic baths, some with parallelepiped geometry and others with cylindrical geometry, used with three different sizes of substrate 3: 10×10 $cm^2$, 15×15 $cm^2$ and 30×60 $cm^2$. This graph demonstrates the advantage of making use of a cylindrical geometry electrochemical device for large substrate 3 surfaces. Indeed, to make an electroplating on a substrate 3 whose surface has an area of 30×60 $cm^2$, the cylindrical device geometry requires about 55 L compared to about 200 L for the parallelepiped geometry bath. With the cylindrical geometry in this example it is possible to achieve a savings of about a factor of four in the volume of electrolytic solution used.

The electroplating device which is the subject of the present invention, for example as shown in FIG. 1, advantageously includes a hollow cylindrical substrate carrier, closed at both ends by two toothed discs 10. The electrical contacts connecting the supply 9 to the substrate 3 forming cathode 8 are routed by a hollow shaft 6 advantageously arranged above the closed cylinder 1. The electrical contact for the cathode can thus follow the rotation of the substrate 3 without being twisted. Preferably it involves a turning electrical contact. Advantageously, the hollow shaft 6 can contain, on the upper portion of the closed cylinder 1, a collar forming a cover 11 intended to close the upper end of the tank 2. This makes it possible to avoid evaporation of the electrolytic solution during electroplating phases or else to avoid possible splashes that could otherwise occur. Furthermore, as described above, the presence of a collar 11 that forms a cover serves to seal the tank 2 and inject a neutral gas into it in order to limit the insertion of oxygen present in the outside atmosphere included between the cover and the solution height into the electrolytic solution. This way oxidation of both the submerged parts and non-submerged parts can be avoided at the same time.

The tanks 2, 220, 230, can include openings through which to continuously, or at chosen intervals, inject electrolytic solution. In particular it is possible to provide one opening as an inlet for adding electrolytic solution or rinsing liquid and a second opening as an outlet for evacuating the electrolytic solution or rinsing liquid. With these openings a tank can be reused for plating different chemical elements, which can require electrolytic solutions of different compositions.

On the outer surface thereof, the flexible substrate 3 includes a metal conductor which can be for example molybdenum, titanium, aluminum, copper or any other material commonly used to serve as a conducting metal in an electrolytic bath. Electroplating can advantageously include several steps of plating different chemical elements. Typically, in the production of photosensitive panels, producing a stack of thin layers of different materials is intended, for example a stack of layers including: copper, indium, gallium, selenium, cadmium sulfide and zinc oxide.

Production of a stack of layers calls for more than one electroplating step. Furthermore, the plating of different materials can involve several tanks holding electrolytic baths and annealing enclosures suited to each material to be plated. Consequently, the invention also relates to a facility for electroplating on flexible substrate 3, such as shown for example on FIGS. 3*a* and 3*b*.

As shown in FIG. 3*a*, the closed cylinder 1 is rigidly connected to a carrier arm 60 having an axis of rotation located outside of the tank 2 and substantially parallel to the axis of the first 1 and second 2 cylinders. The attachment of the carrier arm 60 to the closed cylinder 1 can be done with different connection means, like for example, screwing, a weld or clipping. As indicated above, the carrier arm 60 advantageously has, above cylinder 1, a collar 11 forming a cover intended to close the upper ends of the electrolytic tank 2, 201, 220, 230. The arrangement of the tanks 2, 220, 230 and annealing enclosure 201 is advantageously circular so as to make the movement of the carrier arm 60 easier and to reduce the space occupied by the facility.

The carrier arm 60 can turn around an axis outside the tanks 2, 220, 230, translate along the axis of rotation thereof and also move radially relative to the axis of rotation thereof. With such a displacement system for the carrier arm 60, it is consequently possible to route the substrate 3 to any point in the facility.

The facility as shown in FIGS. 3*a* and 3*b* has the advantage of considerably reducing the footprint of a facility for production of photosensitive devices. For example, to make a panel on a 30×60, 30×120 or even 60×120 $cm^2$ substrate, the tank 2 can typically have a 34 cm radius. By supposing that two electrolysis tanks are installed on the same diameter of travel of the carrier arm 60 the footprint of the two reactors would be nearly 70 cm. To leave room for the arm 60 and operators of the facility, it could be advantageous to take four times this dimension, or about 3 m. With such a dimension for the facility, the presence of rinsing reactors between the Cu, In and Ga electroplating and reducing annealing can even be considered, and also between the CdS plating and ZnO electroplating.

It is also conceivable to configure an electroplating device or even a facility in horizontal position instead of vertical. Advantageously, it is then possible to stack the tanks one over the other and to move the carrier arm 60 along the vertical axis to move the substrate 3 from one tank to another. Such a configuration has the advantage of optimizing the floor space by an upward layout.

Example Implementation

Figure 5:
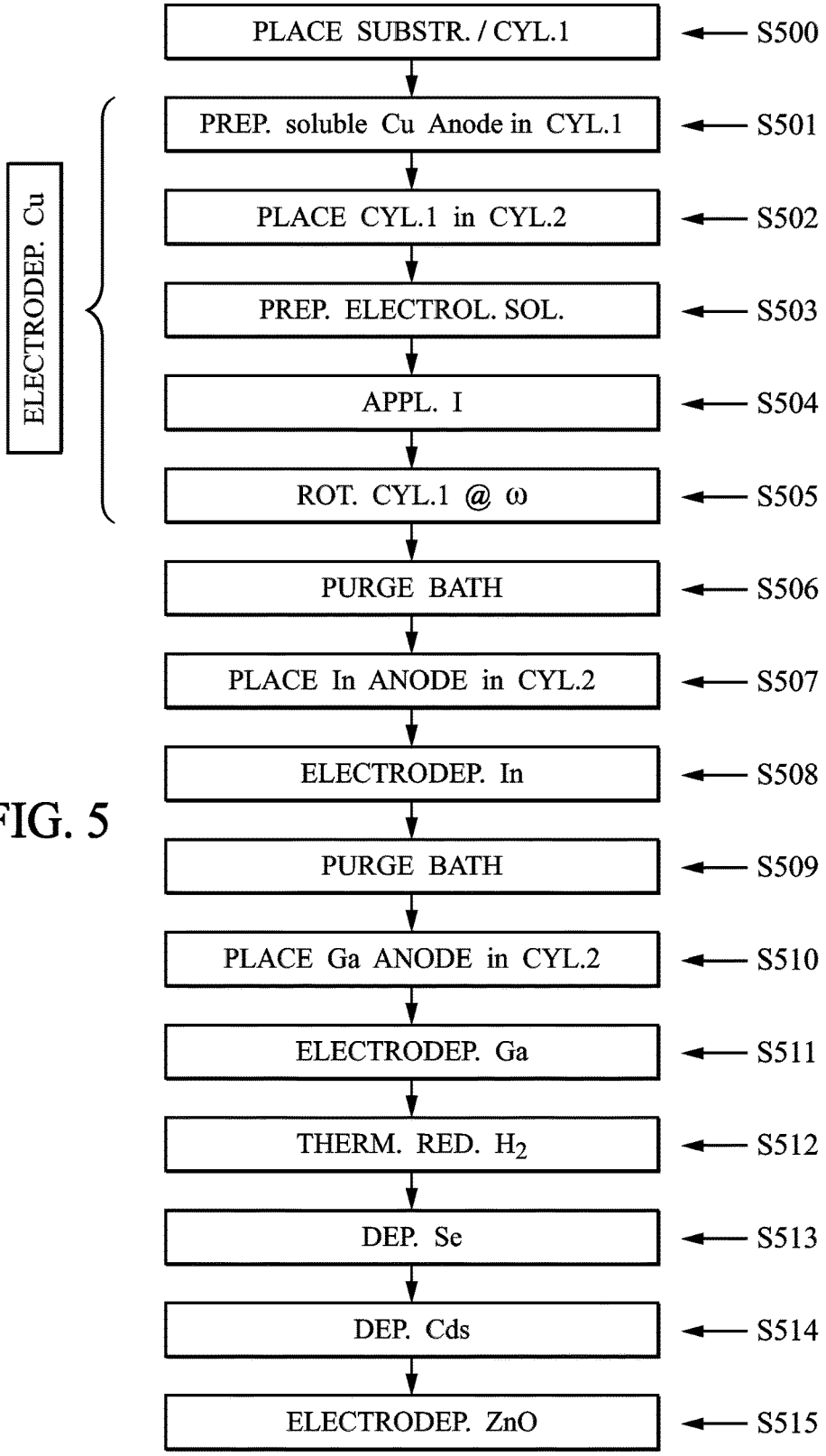
FIG. 5 illustrates the 16 steps of a photovoltaic panel on flexible substrate production method according to an all wet embodiment.

FIG. 5 illustrates a specific implementation example of the invention in 16 steps.

During a first step S500, the flexible substrate comprising a 50 μm thick molybdenum coating is placed in a 10 cm radius and 150 cm high closed cylinder 1.

In step S501, a soluble copper anode is placed in a 34 cm radius and 150 cm high electrically insulating tank 2. A reference electrode 4 is also called for in tank 2.

In step S502, the closed cylinder 1 is placed into cylindrical tank 2, such that the two cylinders are substantially coaxial. Electrical contacts are made to connect a supply 9 both to the flexible substrate 3, to form a cathode, and also to the counter-electrode 7 to form an anode.

In step S503, a 0.25 mol/L concentration sulfuric acid $H_2SO_4$ electrolytic solution containing 1 mol/L of $CuSO_4$ is poured in tank 2.

At step S504, a potential of −1 V relative to the reference potential or a current I of 450 mA is applied between the anode 7 and the cathode 8.

In the following step S505, the closed cylinder 1 is rotated around its axis at a speed of 10 RPM for 15 minutes.

At the end of this step, the copper present in the solution covers the flexible substrate 3 and the copper layer is thus formed.

Because of the progression of the copper ion concentration in the solution, the copper anode 7 is made to dissolve and thus result in a bath with a closely regulated concentration.

It is then followed with a rinsing step S506 of tank 2.

After this rinsing step, a new indium anode 7 is placed in the electrolytic bath filled with sulfuric acid and indium sulfate in step S507.

During step S508, an indium electroplating is then done as previously described.

Analogously to that described above, rinsing is done in tank 2 in step S509, followed by introduction of a soluble gallium anode 7 in step S510 and gallium electroplating in step S511.

Subsequently, the closed cylinder 1 is moved with the carrier arm 60 to the reducing annealing enclosure 201. In step S512 a high temperature reducing annealing under hydrogen atmosphere is done.

This step is followed in step S513 by high temperature selenization in the same enclosure 201 as the previous step.

Next, the closed cylinder 1 is moved to a tank 220 where chemical plating with CdS is done in step S514.

Finally, the closed cylinder 1 is moved to an electrolytic tank 230 in which the photosensitive panel is made through electroplating of a ZnO layer.

The invention is not limited to the embodiments described above, and can include equivalent embodiments.

For example, it is possible to use substantially cylindrical tanks of noncircular section. It is also possible to vary the electroplating parameters during the process, by dynamically modifying the current I, the potential V, the angular velocity ω and the cation concentration C.

The layout of the various elements of the device and the facility can differ from that presented above, in particular in order to increase the ergonomics of the facility. It is also possible to move the substrate 3 using a carrier arm 60 mobile by translation along the three spatial directions.

Providing a simultaneous rotation of tank 2, 220, 230 and the closed cylinder 1 in opposite directions or in the same direction is also conceivable. When the counter-electrode is not the closed cylinder 1 or the tank 2, 220, 230, it is possible to rotate this counter-electrode 7 in the electrolysis bath, around substrate 3 and around the axis thereof.

The filling rate of the tanks can vary from one plating to another. It is thus possible to only partially fill the tanks with electrolytic solution, or to completely fill them.

The invention claimed is:

1. A method for plating a thin layer on a flexible substrate, by electrochemistry, comprising:

providing, in an electrolytic bath, a first closed cylinder inside a second hollow cylinder, the electrolytic bath being filled with an electrolytic solution, the electrolytic solution being comprised in a volume delimited between the first cylinder and the second cylinder, applying the flexible substrate on one surface among an outer surface of the first cylinder and an inner surface of the second cylinder, said flexible substrate forming a first electrode, providing, in said electrolytic bath, at least one second electrode, and applying a potential difference between the first electrode and the second electrode to electroplate the thin layer on the flexible substrate.

2. The method of claim 1, further comprising:

rotating the first cylinder around an axis thereof during electroplating.

3. The method of claim 1, further comprising:

rotating the second electrode.

4. The method of claim 1, further comprising:

providing said first, closed cylinder coaxial, being with said second, hollow cylinder.

5. The method of claim 1, wherein another surface among the outer surface of the first cylinder and the inner surface of the second cylinder is the second electrode.

6. The method of claim 1, further comprising:

providing a second soluble electrode.

7. The method of claim 1, further comprising:

applying the flexible substrate on the outer surface of the first cylinder, and providing a mobile carrier arm connected to the first cylinder.

8. The method of claim 7, further comprising:

displacing the first cylinder from the electrolytic bath in the second cylinder to at least one tank in a third cylinder.

9. The method of claim 7, further comprising:

moving the first cylinder towards an annealing enclosure.

* * * * *